US007389772B2

(12) United States Patent
Park

(10) Patent No.: US 7,389,772 B2
(45) Date of Patent: Jun. 24, 2008

(54) IGNITION COIL ASSEMBLY FOR ENGINE

(75) Inventor: Seongmin Park, Gunpo (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/603,871

(22) Filed: Nov. 22, 2006

(65) Prior Publication Data

US 2008/0047534 A1 Feb. 28, 2008

(30) Foreign Application Priority Data

Aug. 24, 2006 (KR) ..... 10-2006-0080668

(51) Int. Cl.
*F02P 3/02* (2006.01)
*F02P 7/00* (2006.01)

(52) U.S. Cl. ..... 123/634; 123/635

(58) Field of Classification Search ..... 123/634, 123/635

See application file for complete search history.

(56) References Cited

U.S. PATENT DOCUMENTS

| | | | | |
|---|---|---|---|---|
| 4,903,675 | A * | 2/1990 | Huntzinger et al. | 123/635 |
| 5,109,828 | A * | 5/1992 | Tagami et al. | 123/635 |
| 6,543,430 | B2 * | 4/2003 | Moga et al. | 123/634 |
| 6,776,147 | B2 * | 8/2004 | Tsunenaga et al. | 123/635 |
| 2004/0231652 | A1 * | 11/2004 | Kondo et al. | 123/634 |
| 2005/0161031 | A1 * | 7/2005 | Cavarero et al. | 123/635 |
| 2007/0012301 | A1 * | 1/2007 | Tauchi et al. | 123/634 |
| 2007/0023019 | A1 * | 2/2007 | Hamada et al. | 123/634 |
| 2007/0039599 | A1 * | 2/2007 | Skinner et al. | 123/647 |

* cited by examiner

*Primary Examiner*—Erick Solis
(74) *Attorney, Agent, or Firm*—Morgan Lewis & Bockius LLP

(57) ABSTRACT

An ignition coil assembly for an engine includes an ignition coil for supplying a voltage to a spark plug, a housing supporting the ignition coil, a driving circuit board disposed on the housing and including a circuit unit controlling the ignition coil, and a center cover protecting the driving circuit board. The ignition coil is electrically connected to the driving circuit board.

1 Claim, 6 Drawing Sheets

IGNITION COIL ASSEMBLY FOR ENGINE

CROSS-REFERENCE TO RELATED APPLICATION

This application claims priority to and the benefit of Korean Patent Application No. 10-2006-0080668 filed in the Korean Intellectual Property Office on Aug. 24, 2006, the entire contents of which are incorporated herein by reference.

BACKGROUND OF THE INVENTION (a) Field of the Invention

The present invention relates to an ignition coil assembly for an engine, and more particularly, to an ignition coil assembly having a driving circuit board and a center cover, which are integrated with each other to prevent contact defect and accidental fire of an ignition coil due to a wiring harness short circuit.

(b) Description of the Related Art

In a conventional ignition coil assembly, ignition coils are individually mounted on a head cover of an engine and are supplied with electric power through a wiring harness. The wiring harness is generally fixed by a bracket and bolt and protected by a center cover.

However, since the ignition coils are installed in a very narrow space, it is very difficult to connect the wiring harness to the ignition coils.

The ignition coils may be integrated together and made as one assembly, which must be replaced as a whole, even when only one ignition coil malfunctions.

In another conventional ignition coil assembly, individual ignition coils are formed in a separable structure. Lots of components are employed, thereby increasing the production costs. In addition, since the electrical/mechanical coupling force is weak, it is difficult to obtain a desired high level of quality.

In both conventional ignition coil assemblies, the space for mounting the ignition coils is small and the chance of a short circuit between the connectors is high. In addition, since the assembling process is complicated, the production cost increases.

The above information disclosed in this Background section is only for enhancement of understanding of the background of the invention and therefore it may contain information that does not form the prior art that is already known in this country to a person of ordinary skill in the art.

SUMMARY OF THE INVENTION

An exemplary embodiment of the present invention provides an ignition coil assembly for an engine including an ignition coil for supplying a high voltage to a spark plug, a housing supporting the ignition coil, a driving circuit board disposed on the housing and provided with a circuit unit controlling the ignition coil, and a center cover protecting the driving circuit board. The ignition coil is electrically connected to the driving circuit board.

The electrical connection between the ignition coil and the driving circuit board may include a female terminal of the driving circuit board and a male terminal of the ignition coil.

The center cover and the driving circuit board may be integrally formed together through an insert injection molding process.

The housing and the driving circuit board may be integrally formed together through an insert injection molding process.

The center cover, the housing, and the driving circuit board may be integrally formed together through an insert injection molding process.

The ignition coil assembly may further include a supporting unit for supporting the male terminal of the ignition coil.

The ignition coil may be provided with an opening for filling epoxy.

A connector for an external connection may be provided on an end of the driving circuit board, the connector having a plurality of pins.

The center cover may be coupled to the ignition coil by a coupling member, such as a bolt, such that the center cover and the ignition coil can be disassembled.

The terminal of the driving circuit board may be formed in a plate shape.

The ignition coil assembly may further include a terminal box enclosing the terminal of the ignition coil.

The ignition coil assembly may further include a terminal cover for preventing the terminal of the ignition coil from being removed.

DETAILED DESCRIPTION OF THE PREFERRED EMBODIMENTS

An exemplary embodiment of the present invention will hereinafter be described in detail with reference to the accompanying drawings.

Figure 1:
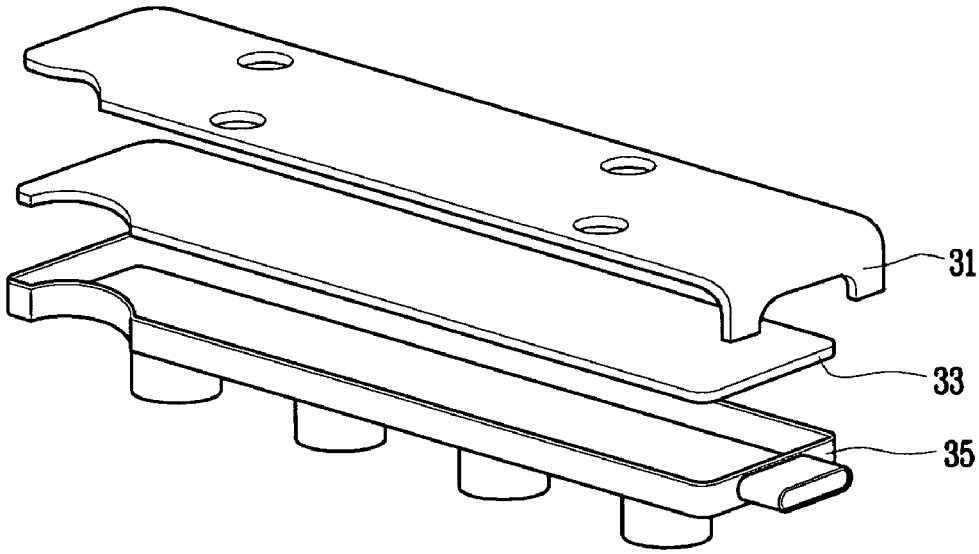
FIG. 1 is an exploded perspective view of a center cover portion according to an exemplary embodiment of the present invention.

Referring to FIG. 1, a driving circuit board 33 is interposed between a center cover 31 and a housing 35. The center cover 31 and the housing 35 are illustrated in a state where they are separated from each other. However, at least two of the three parts (center cover 31, driving circuit board 33, and housing 35) may be integrally formed together.

The center cover 31 and the driving circuit board 33 may be integrally formed together through an insert injection molding process. Alternatively, the housing 35 and the driving circuit board 33 may be integrally formed together through an insert injection molding process. Alternatively, the center cover 31, the housing 35, and the driving circuit board 33 may be integrally formed together through an insert injection molding process.

When the above-mentioned components are integrally formed together through the insert injection molding process, the number of components is reduced and the number of manufacturing processes is reduced, thereby reducing the production cost.

Figure 2:
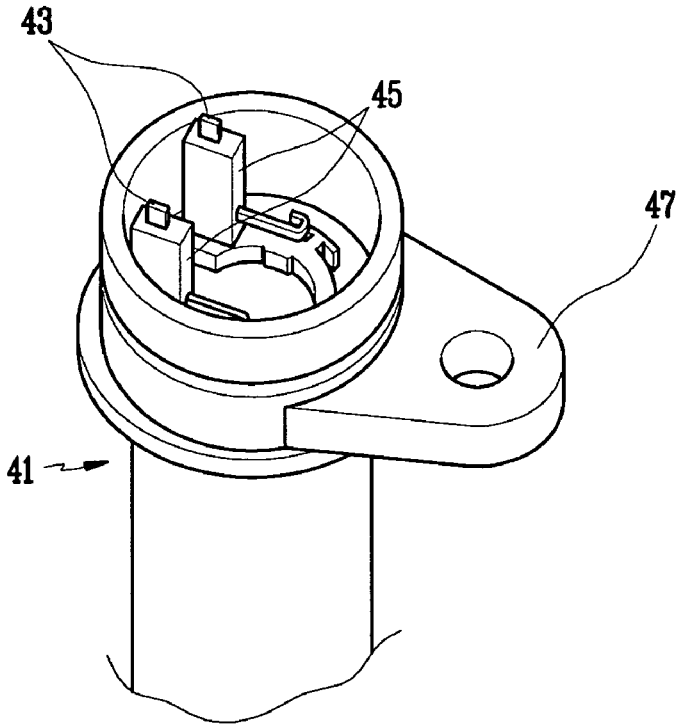
FIG. 2 is a perspective view of an ignition coil according to an exemplary embodiment of the present invention.
Figure 3:
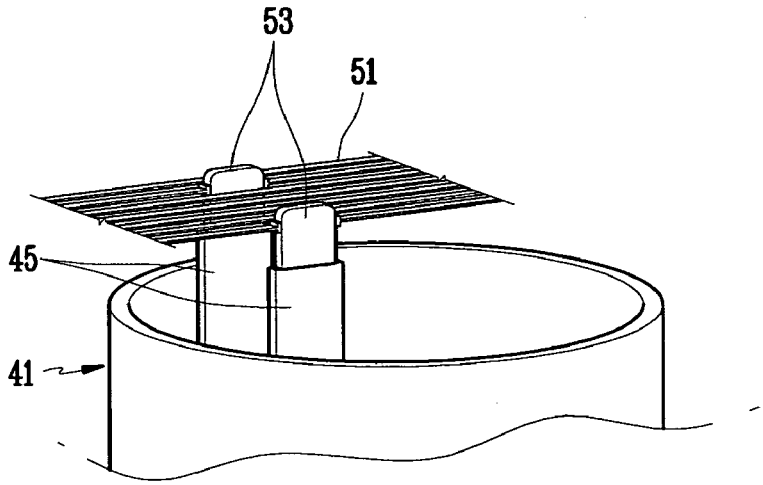
FIG. 3 is a perspective view of a portion where a terminal of an ignition coil is coupled to a terminal of a driving circuit board according to an exemplary embodiment of the present invention.

Referring to FIGS. 2 and 3, in a first exemplary embodiment, a circuit unit 51 and a driving circuit board female terminal box 53 are connected to each other. The circuit unit 51 encloses an ignition coil male terminal (43 of FIG. 2).

As the female terminal of the driving circuit board is interlocked with the male terminal 43 of the ignition coil 41, the maintenance of the ignition coils 41 is more effective. That is, when one or more of the ignition coils malfunction, only the malfunctioning ignition coil need to be separated to be repaired or replaced.

Figure 8:
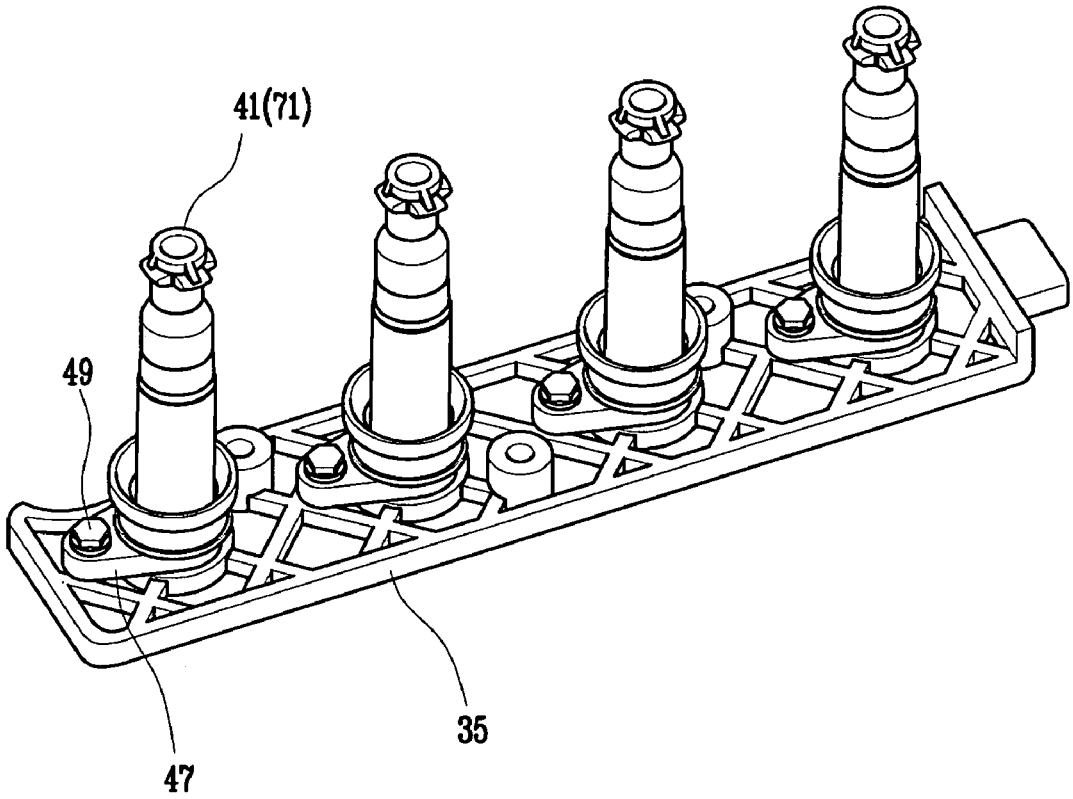
FIG. 8 is a rear perspective view of an ignition coil assembly for an engine according to an exemplary embodiment of the present invention.

Referring to FIG. 8, the ignition coil 41 is coupled to the housing 35 by a coupling member 47.

In order to prevent the male terminal 43 of the ignition coil 41 from being bent, the male terminal 43 of the ignition coil 41 is covered by a male terminal supporting portion 45.

Figure 4A:
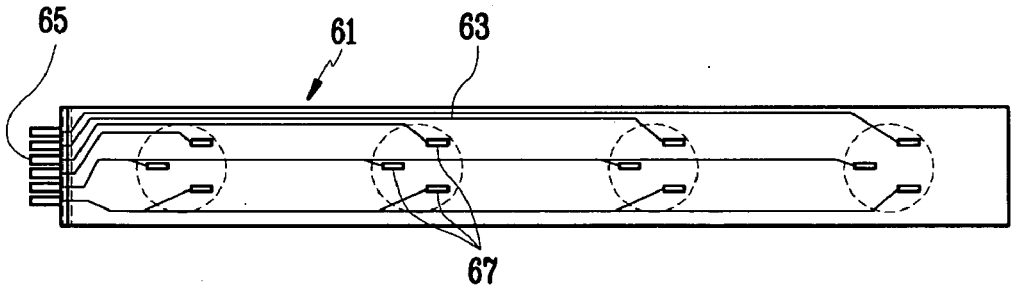
FIGS. 4A and 4B are respectively top and side views of a driving circuit board according to another exemplary embodiment of the present invention.
Figure 4B:
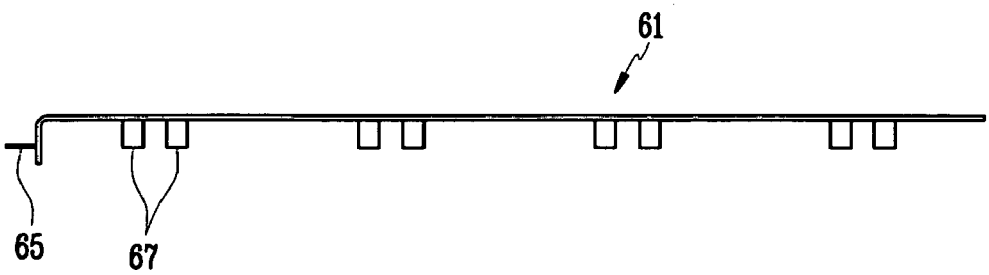

Referring to FIGS. 4A and 4B, in another exemplary embodiment, a driving circuit board 61 includes a circuit unit 63, a connector 65, through which electric power and external signal are applied, ignition coils controlled by the circuit unit 63, and terminal portions 67 that are terminal coupled.

The connector 65 includes a plurality of pins and is provided on an end of the driving circuit board 61. The terminals 67 may be male or female terminals, and, in an exemplary embodiment, may be male terminals each formed in a plate shape.

Figure 5:
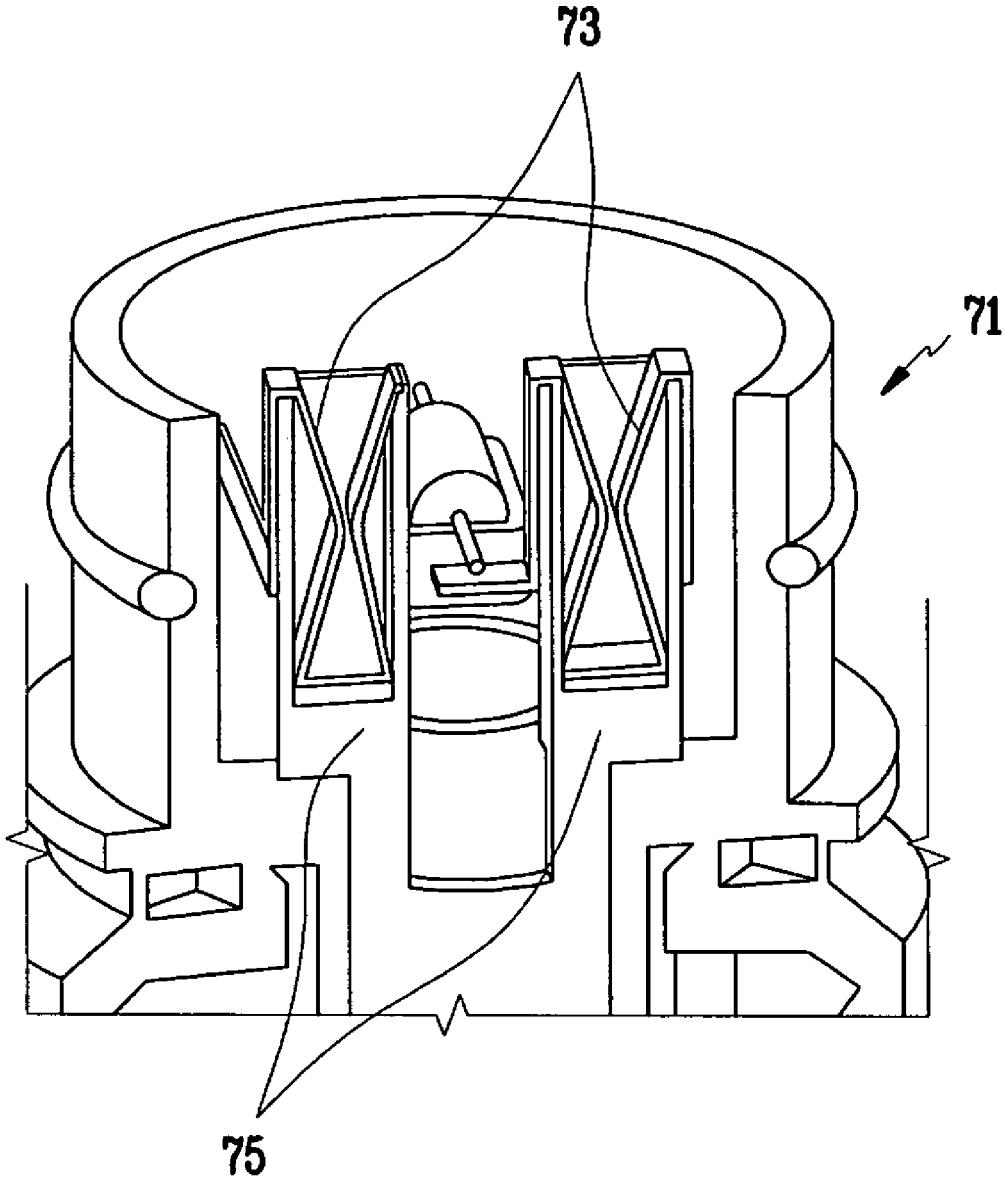
FIG. 5 is a partly sectioned perspective view illustrating a terminal portion of an ignition coil according to another exemplary embodiment of the present invention.

Referring to FIG. 5, the ignition coil terminal boxes 75 enclose the terminals 73 to prevent them from being insulated by injection of resin.

Figure 6:
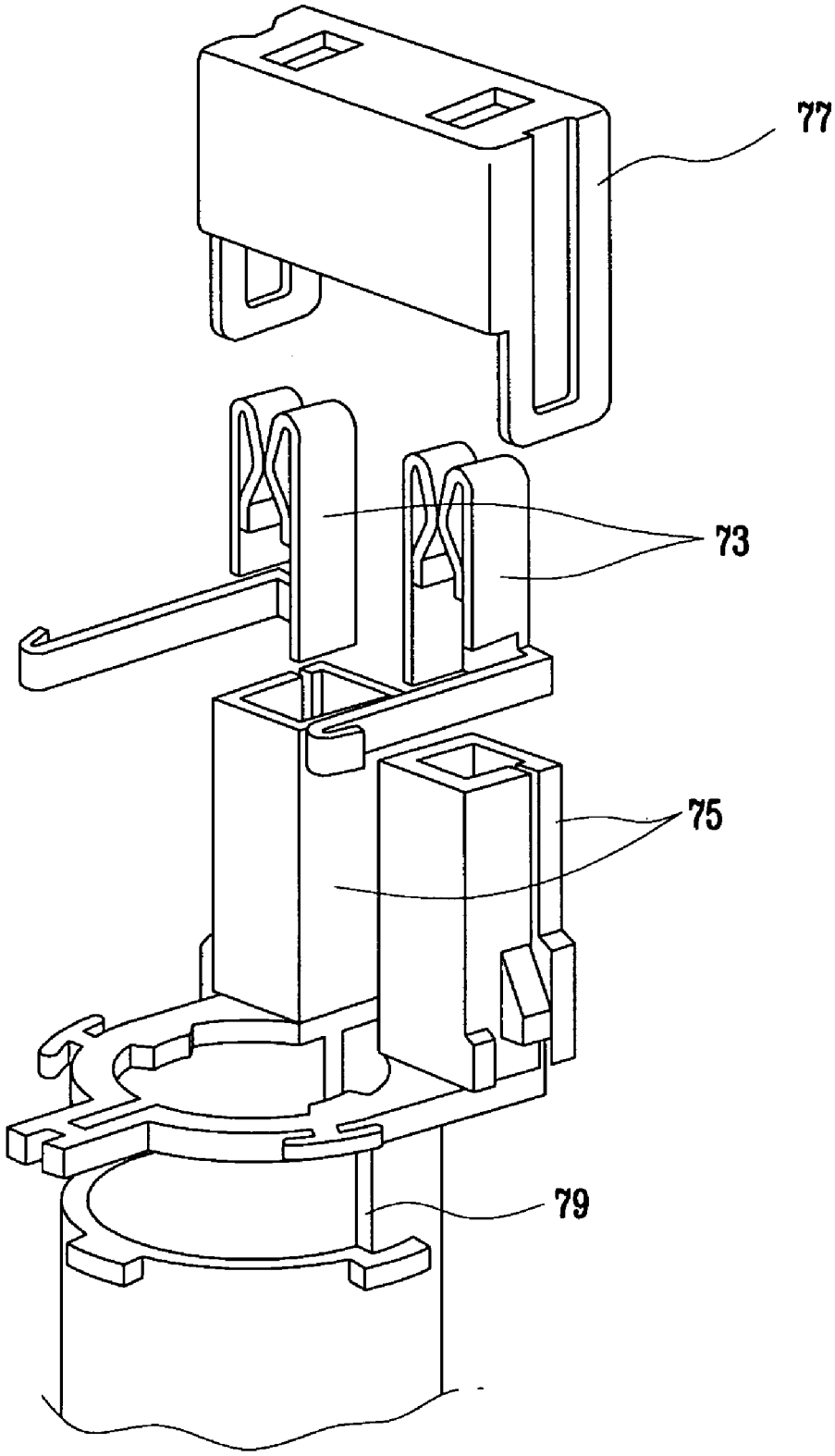
FIG. 6 is an exploded perspective view of the terminal portion of the ignition coil of FIG. 5.
Figure 7:
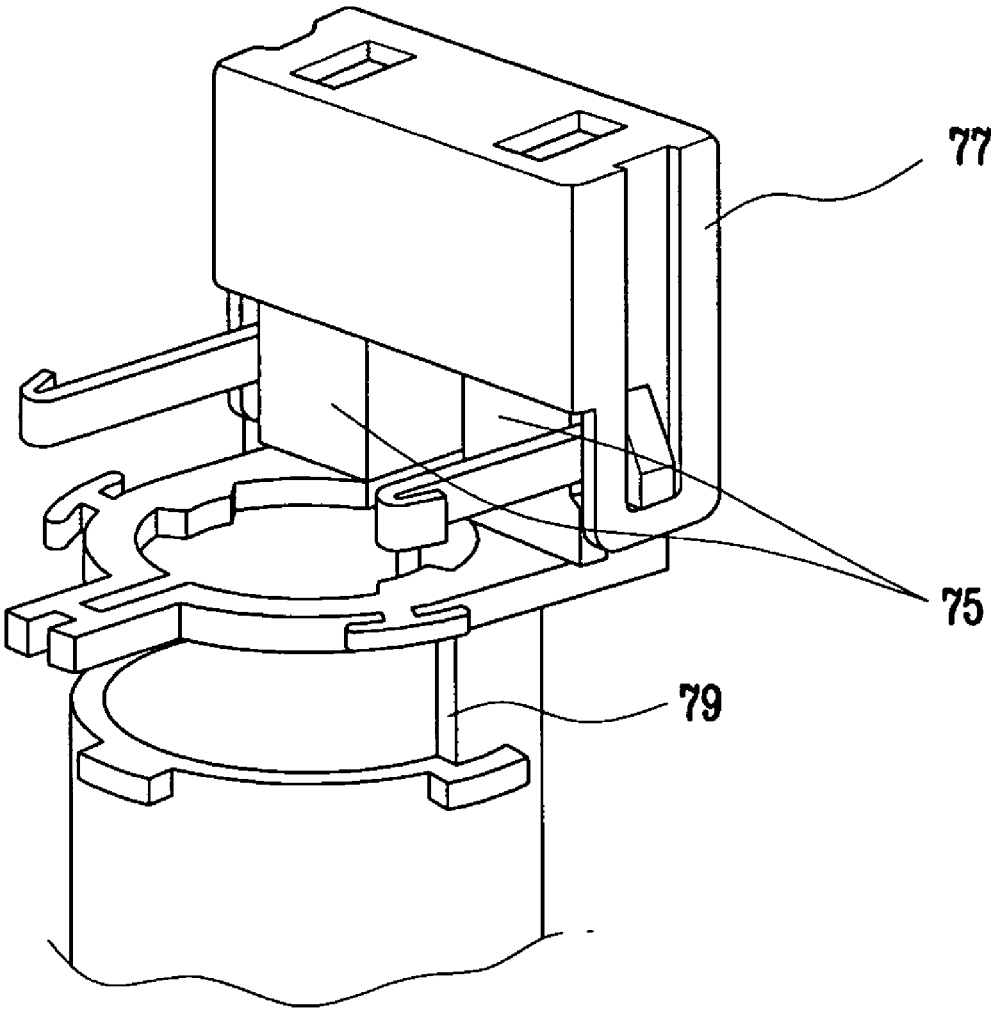
FIG. 7 is a perspective view of the terminal portion of the ignition coil, when the terminal portion is assembled.

In addition, in order to prevent the female terminals 73 of the ignition coil 71 from being separated upward and away from the ignition coil 71, as shown in FIGS. 6 and 7, a terminal cover 77 may be mounted above the terminals 73 and the terminal boxes 75.

An opening 79 is provided under the terminals 73 of the ignition coil 71 to fill the resin up in the bottom during the injection of the resin.

The following will describe the coupling of the ignition coil to the housing.

As shown in FIG. 8, the ignition coils 41, 71 are individually coupled to the housing 35; they can thus be individually repaired or replaced during maintenance after being separated independently from the others.

The coupling portion 49 may include a bolt so that the separation of the ignition coil 41 can be easily accomplished.

As described above, the ignition coil assembly of the present invention has the following effects:

Since the assembly is formed in a module type and a wiring harness is not used, the number of components and the weight can be reduced, thereby reducing the production cost. Furthermore, since the ignition coil assembly has a simple structure, the shape of the ignition coil, which up to now has had various designs for different vehicles, can be standardized. Since the ignition coils are designed to be individually coupled and uncoupled to the housing, maintenance can be easily performed. For example, when one of the ignition coils malfunctions, the relevant ignition coil is dissembled from the housing and repaired or replaced. Therefore, the maintenance cost can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An ignition coil assembly for an engine, comprising:

an ignition coil for supplying a voltage to a spark plug;

a housing supporting the ignition coil;

a driving circuit board disposed on the housing, electrically connected to the ignition coil, and comprising a circuit unit controlling the ignition coil; and a center cover protecting the driving circuit board;

wherein the driving circuit board is integrally formed together with at least one of the center cover and the housing through an injection molding process.

* * * * *